US010849417B2

(12) United States Patent
Moskovich

(10) Patent No.: US 10,849,417 B2
(45) **Date of Patent: *Dec. 1, 2020**

(54) ORAL CARE IMPLEMENT

(71) Applicant: Colgate-Palmolive Company, New York, NY (US)

(72) Inventor: Robert Moskovich, Manakin-Sabot, VA (US)

(73) Assignee: Colgate-Palmolive Company, New York, NY (US)

( * ) Notice: Subject to any disclaimer, the term of this patent is extended or adjusted under 35 U.S.C. 154(b) by 163 days.

This patent is subject to a terminal disclaimer.

(21) Appl. No.: 16/159,778

(22) Filed: Oct. 15, 2018

(65) Prior Publication Data

US 2019/0045914 A1 Feb. 14, 2019

Related U.S. Application Data

(63) Continuation of application No. 14/968,607, filed on Dec. 14, 2015, now Pat. No. 10,136,723.

(51) Int. Cl.

| | |
|---|---|
| ***A46B 9/04*** | (2006.01) |
| ***A46D 1/00*** | (2006.01) |
| ***A46B 3/00*** | (2006.01) |
| ***A46B 5/02*** | (2006.01) |
| ***A46B 9/02*** | (2006.01) |

(52) U.S. Cl.

CPC ..... *A46B 9/04* (2013.01); *A46B 3/005* (2013.01); *A46B 5/02* (2013.01); *A46B 9/028* (2013.01); *A46D 1/0238* (2013.01); *A46D 1/0261* (2013.01); *A46B 2200/1066* (2013.01)

(58) Field of Classification Search

CPC ..... A46B 9/04; A46B 9/028; A46D 1/02

See application file for complete search history.

(56) References Cited

U.S. PATENT DOCUMENTS

| | | | |
|---|---|---|---|
| 1,817,585 | A | 8/1931 | Samuel |
| 1,924,152 | A | 8/1933 | Coney et al. |
| 2,225,331 | A | 12/1940 | Campbell |

(Continued)

FOREIGN PATENT DOCUMENTS

| | | |
|---|---|---|
| CN | 2684634 | 3/2005 |
| CN | 100354102 | 8/2005 |

(Continued)

OTHER PUBLICATIONS

The International Search Report and the Written Opinionn issued by the International Searching Authority in International Application PCT/US2016/066068 dated May 23, 2017.

*Primary Examiner* — Michael D Jennings

(57) ABSTRACT

An oral care implement that includes a handle and a head. The head may include a support structure and a monolithic cleaning unit coupled thereto. The monolithic cleaning unit may include a base portion coupled to the support structure and a plurality of bristles extending therefrom. At least one, or each, of the plurality of bristles may comprise a body having an outer surface and a rib extending from the outer surface. The rib may be longitudinally elongated in some embodiments and it may be helical in other embodiments. Furthermore, there may be more than one rib extending from the outer surface of the body. The monolithic cleaning unit may be formed of an elastomeric material.

20 Claims, 12 Drawing Sheets

(56) References Cited

U.S. PATENT DOCUMENTS

| | | | | |
|---|---|---|---|---|
| 2,545,814 | A | 3/1951 | Kempster | |
| 4,128,910 | A | 12/1978 | Nakata et al. | |
| 4,373,541 | A | 2/1983 | Nishioka | |
| 5,531,582 | A | 7/1996 | Klinkhammer | |
| 5,908,038 | A | 6/1999 | Bennett | |
| 5,926,900 | A * | 7/1999 | Bennett | A46B 1/00 15/167.1 |
| 5,930,860 | A | 8/1999 | Shipp | |
| 5,987,688 | A | 11/1999 | Roberts et al. | |
| 6,067,684 | A | 5/2000 | Kweon | |
| 6,138,315 | A | 10/2000 | Schmitt et al. | |
| 6,161,243 | A | 12/2000 | Weihrauch | |
| 6,311,358 | B1 | 11/2001 | Soetewey et al. | |
| 6,402,494 | B1 | 6/2002 | Lanvers | |
| 6,463,618 | B1 | 10/2002 | Zimmer | |
| 6,641,764 | B2 | 11/2003 | Lanvers | |
| 6,886,207 | B1 | 5/2005 | Solanki | |
| 6,966,093 | B2 | 11/2005 | Eliav et al. | |
| 7,137,163 | B2 | 11/2006 | Gatzemeyer et al. | |
| 7,226,555 | B2 | 6/2007 | Weihrauch | B29C 45/14344 264/163 |
| 7,322,067 | B2 | 1/2008 | Hohlbein | |
| 7,419,626 | B2 | 9/2008 | Mark | |
| 7,503,093 | B2 | 3/2009 | Weihrauch | A46B 3/22 15/167.1 |
| 7,644,466 | B2 | 1/2010 | Weihrauch et al. | |
| 7,908,699 | B2 | 3/2011 | Hohlbein et al. | |
| 7,941,886 | B2 * | 5/2011 | Chenvainu | A46B 9/005 15/22.4 |
| 7,958,589 | B2 | 6/2011 | Braun et al. | |
| 8,156,599 | B2 | 4/2012 | Waguespack et al. | |
| 8,444,416 | B2 | 5/2013 | Chenvainu et al. | |
| 8,522,386 | B2 | 9/2013 | Hohlbein | |
| 8,584,301 | B2 | 11/2013 | Maissami | |
| 8,677,541 | B2 | 3/2014 | Meadows et al. | |
| 8,695,146 | B2 | 4/2014 | Waguespack et al. | |
| 8,734,042 | B2 | 5/2014 | Hohlbein et al. | |
| RE45,141 | E * | 9/2014 | Fischer | 15/110 |
| 9,220,335 | B2 * | 12/2015 | Braun | A46B 9/06 |
| 1,327,757 | A1 | 1/2020 | Eggers | |
| 2004/0170464 | A1 | 9/2004 | Polczynski | |
| 2005/0160546 | A1 * | 7/2005 | Weihrauch | A46D 1/00 15/207.2 |
| 2005/0272001 | A1 | 12/2005 | Blain et al. | |
| 2006/0240380 | A1 * | 10/2006 | Chenvainu | A46B 11/0086 433/80 |
| 2011/0179595 | A1 * | 7/2011 | Chenvainu | A46B 13/008 15/167.1 |
| 2012/0174328 | A1 * | 7/2012 | Moskovich | A46B 5/02 15/106 |
| 2012/0272469 | A1 | 11/2012 | Kwpn et al. | |
| 2013/0291320 | A1 | 11/2013 | Kirchhofer | A46B 1/00 15/22.1 |
| 2013/0318732 | A1 * | 12/2013 | Mintel | A46D 1/0276 15/167.1 |
| 2013/0333132 | A1 * | 12/2013 | Loetscher | A46B 9/04 15/167.1 |
| 2014/0082871 | A1 | 3/2014 | Su et al. | |
| 2014/0123423 | A1 | 5/2014 | Morgott | |
| 2014/0137355 | A1 | 5/2014 | Lee | A46B 9/04 15/167.1 |
| 2014/0359959 | A1 | 12/2014 | Jungnickel et al. | |
| 2015/0135456 | A1 | 5/2015 | Kirchhofer et al. | |

FOREIGN PATENT DOCUMENTS

| | | |
|---|---|---|
| CN | 2870580 Y | 2/2007 |
| CN | 201029569 | 3/2008 |
| CN | 201073079 | 6/2008 |
| CN | 201500200 | 6/2010 |
| CN | 201524149 | 7/2010 |
| CN | 201563889 | 9/2010 |
| CN | 101912194 | 12/2010 |
| CN | 201691299 | 1/2011 |
| CN | 201831193 | 5/2011 |
| CN | 201831194 | 5/2011 |
| CN | 102113766 | 7/2011 |
| CN | 201905438 | 7/2011 |
| CN | 201958092 | 9/2011 |
| CN | 202525422 | 1/2012 |
| CN | 202436183 | 9/2012 |
| CN | 202445381 | 9/2012 |
| CN | 102763980 | 11/2012 |
| CN | 202698210 | 1/2013 |
| CN | 202858192 | 4/2013 |
| CN | 203028453 | 7/2013 |
| CN | 203028478 | 7/2013 |
| CN | 103242644 | 8/2013 |
| CN | 103254401 | 8/2013 |
| CN | 203152891 | 8/2013 |
| CN | 103327847 | 9/2013 |
| CN | 103385599 | 11/2013 |
| CN | 103660126 | 3/2014 |
| CN | 203467913 | 3/2014 |
| CN | 203600517 | 5/2014 |
| CN | 203776358 | 8/2014 |
| CN | 104223758 | 12/2014 |
| CN | 203969611 | 12/2014 |
| CN | 204181157 | 3/2015 |
| CN | 104490624 | 4/2015 |
| CN | 204378291 | 6/2015 |
| CN | 204393668 | 6/2015 |
| CN | 204393669 | 6/2015 |
| DE | 199255568 | 12/2000 |
| DE | 20308452 | 7/2003 |
| DE | 10235642 | 2/2004 |
| DE | 10303548 | 8/2004 |
| DE | 202014000437 | 3/2015 |
| EP | 2091384 | 8/2009 |
| EP | 2144529 | 1/2010 |
| EP | 2929803 | 10/2015 |
| GB | 189624935 | 11/1896 |
| GB | 2354432 | 3/2001 |
| JP | 2000308524 | 11/2000 |
| JP | 2006149419 | 6/2006 |
| KR | 20040084341 | 10/2004 |
| KR | 20060026646 | 3/2006 |
| TW | 201236601 | 9/2012 |
| WO | 1994/013461 | 6/1994 |
| WO | wo2000/64307 | 11/2000 |
| WO | wo2009/072747 | 6/2009 |
| WO | wo2011/06346 | 1/2011 |

* cited by examiner

ORAL CARE IMPLEMENT

CROSS-REFERENCE TO RELATED APPLICATIONS

This application is a continuation of U.S. patent application Ser. No. 14/968,607, filed Dec. 14, 2015, the entirety of which is incorporated herein by reference.

BACKGROUND

Conventional toothbrushes include a head with tooth cleaning elements thereon. In typical toothbrushes, the tooth cleaning elements are bristles formed of nylon or a similar filament material. Due to the small diameter of such nylon bristles, a toothbrush may include thousands of discrete bristles arranged in tufts and coupled to the head, each of the discrete bristles forming a distinct end point for cleaning. Recently, toothbrushes have been manufactured with the bristles formed via injection molding. In such toothbrushes, the bristles are much larger than conventional filament bristles and as a result there are many fewer bristles on the head, which results in fewer end points for cleaning. In toothbrushes using this newer technology, the number of distinct end points on the bristles that may contact a user's teeth and other oral surfaces during toothbrushing is significantly reduced relative to conventional toothbrushes that use filament bristles. Thus, a need exists for a toothbrush having injection molded bristles with an increased number of contact points for more effectively cleaning a user's teeth and other oral surface.

BRIEF SUMMARY

The present invention may be directed, in one aspect, to an oral care implement that includes a handle and a head. The head may comprise a support structure and a monolithic cleaning unit coupled thereto. The monolithic cleaning unit may include a base portion coupled to the support structure and a plurality of bristles extending therefrom. At least one, or each, of the plurality of bristles may comprise a body having an outer surface and a rib extending from the outer surface. The rib may be longitudinally elongated in some embodiments and it may be helical in other embodiments. Furthermore, there may be more than one rib extending from the outer surface of the body. The monolithic cleaning unit may be formed of an elastomeric material.

In one aspect, the invention may be an oral care implement comprising a handle and a head having a front surface and an opposing rear surface, the head comprising a support structure and a monolithic cleaning unit, the monolithic cleaning unit comprising: a base portion coupled to the support structure and forming a portion of the front surface of the head; and a plurality of bristles extending from the base portion and protruding from the front surface of the head; wherein at least one of the plurality of bristles comprises: a body having an outer surface that extends along a longitudinal axis from a proximal end that is adjacent the base portion of the monolithic cleaning unit to a distal end that is spaced from the front surface of the head; and a plurality of longitudinally elongated ribs extending from the outer surface of the body in a circumferentially spaced apart manner.

In another aspect, the invention may be an oral care implement comprising a handle and a head having a front surface and an opposing rear surface, the head comprising a support structure and a monolithic cleaning unit, the monolithic cleaning unit comprising: a base portion coupled to the support structure and forming a portion of the front surface of the head; and a plurality of bristles extending from the base portion and protruding from the front surface of the head; wherein at least one of the plurality of bristles comprises: a body having an outer surface, the body extending along a longitudinal axis and having a length measured between a proximal end that is adjacent the base portion of the monolithic cleaning unit and a distal end that is spaced from the front surface of the head; and at least one longitudinally elongated rib extending from the outer surface of the body along a majority of the length of the body.

In yet another aspect, the invention may be an oral care implement comprising a handle and a head having a front surface and an opposing rear surface, the head comprising a support structure and a monolithic cleaning unit, the monolithic cleaning unit comprising: a base portion coupled to the support structure and forming a portion of the front surface of the head; and a plurality of bristles extending from the base portion and protruding from the front surface of the head; wherein at least one of the plurality of bristles comprises: a body having an outer surface, the body extending along a longitudinal axis and having a first longitudinal section extending from a proximal end adjacent the base portion of the monolithic cleaning unit to a distal end and a second longitudinal section extending from the distal end of the first longitudinal section to a distal end of the second longitudinal section, the first longitudinal section having a minimum diameter that is greater than a maximum diameter of the second longitudinal section; and at least one rib extending from the outer surface of the body and located entirely on the second longitudinal section of the body.

In still another aspect, the invention may be an oral care implement comprising a handle and a head having a front surface and an opposing rear surface, the head comprising a support structure and a monolithic cleaning unit, the monolithic cleaning unit comprising: a base portion coupled to the support structure and forming a portion of the front surface of the head; and a plurality of bristles extending from the base portion and protruding from the front surface of the head; wherein at least one of the plurality of bristles comprises: a cylindrical body extending along a longitudinal axis from a proximal end that is adjacent the base portion of the monolithic cleaning unit to a distal end, the cylindrical body tapering from the proximal end to the distal end; and at least one rib extending from an outer surface of the cylindrical body, a height that the at least one rib extends from the outer surface of the cylindrical body increasing with distance from the proximal end of the cylindrical body towards the distal end of the cylindrical body.

In a further aspect, the invention may be an oral care implement comprising a handle and a head having a front surface and an opposing rear surface, the head comprising a support structure and a monolithic cleaning unit, the monolithic cleaning unit comprising: a base portion coupled to the support structure and forming a portion of the front surface of the head; and a plurality of bristles extending from the base portion and protruding from the front surface of the head; wherein at least one of the plurality of bristles comprises: a body having an outer surface that extends along a longitudinal axis from a proximal end that is adjacent the base portion of the monolithic cleaning unit to a distal end; and at least one rib extending from the outer surface of the body in a helical manner about the longitudinal axis.

In a still further aspect, the invention may be an oral care implement comprising: a handle and a head having a front surface and an opposing rear surface, the head comprising a support structure and a monolithic cleaning unit, the monolithic cleaning unit comprising: a base portion coupled to the support structure and forming a portion of the front surface of the head; and a plurality of bristles extending from the base portion and protruding from the front surface of the head; wherein at least one of the plurality of bristles comprises a body extending along a longitudinal axis, the body having a first longitudinal section extending from the base portion of the monolithic cleaning unit to a distal end and a second longitudinal section extending from the distal end of the first longitudinal section, the distal end of the first longitudinal section protruding radially from the second longitudinal section, each of the first and second longitudinal sections of the body tapering in a direction away from the base portion of the monolithic cleaning unit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
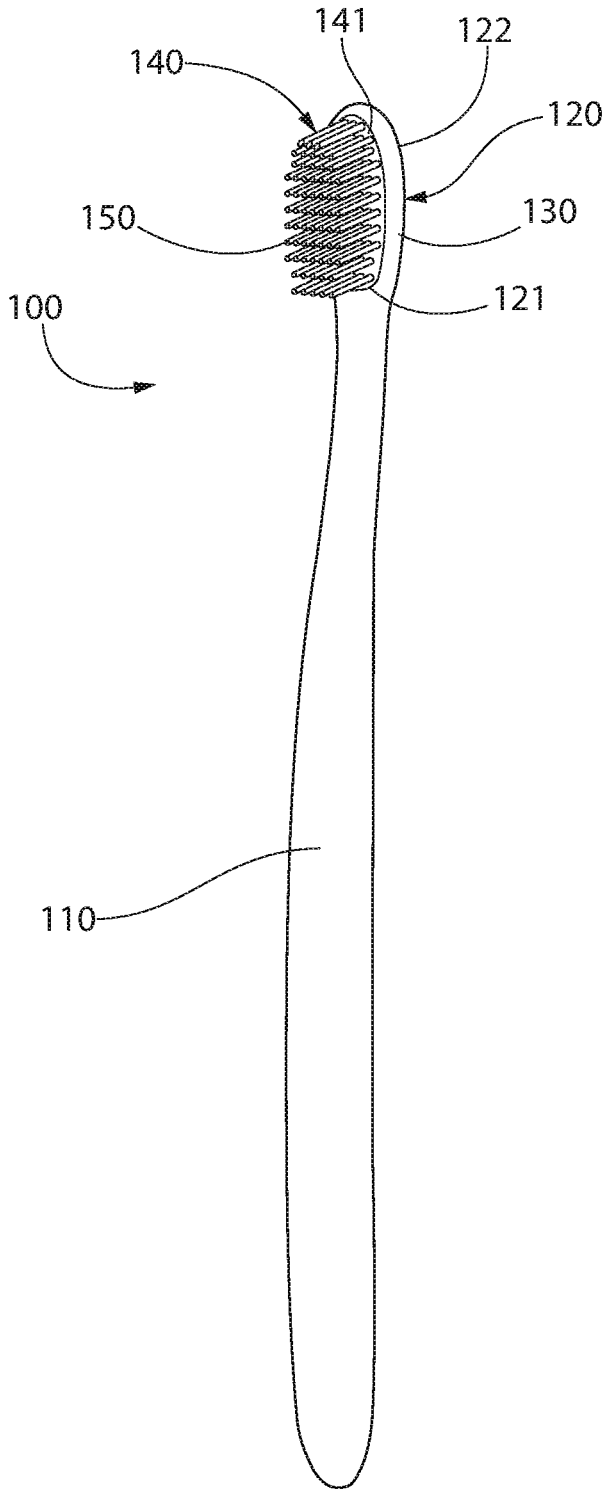
FIG. 1 is perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Referring to FIG. 1, an oral care implement 100 will be described in accordance with an embodiment of the present application. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having cleaning elements, or any other type of implement that is commonly used for oral care.

The oral care implement 100 generally comprises a handle 110 and a head 120. The handle 110 is an elongated structure that provides the mechanism by which the user can hold and manipulate the oral care implement 100 during use. In the exemplified embodiment, the handle 110 is generically depicted having various contours for user comfort. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims.

The handle 110 may be formed of a hard or rigid plastic material, such as for example without limitation polymers and copolymers of ethylene, propylene, butadiene, vinyl compounds, and polyesters such as polyethylene terephthalate. The handle 110 may also include a grip that is formed of a resilient/elastomeric material, such as a thermoplastic elastomer. Such a grip may be molded over a portion of the handle 110 that is typically gripped by a user's thumb and forefinger during use. Furthermore, it should be appreciated that additional regions of the handle 110 can be overmolded with the resilient/elastomeric material to enhance the gripability of the handle 110 during use. For example, portions of the handle 110 that are typically gripped by a user's palm during use may be overmolded with a thermoplastic elastomer or other resilient material to further increase comfort to a user. Furthermore, materials other than those noted above can be used to form the handle 110, including metal, wood, or any other desired material that has sufficient structural rigidity to permit a user to grip the handle 110 and manipulate the oral care implement 100 during toothbrushing.

The head 120 of the oral care implement 100 is coupled to the handle 110 and comprises a front surface 121 and an opposing rear surface 122. In the exemplified embodiment, the head 120 is formed integrally with the handle 110 as a single unitary structure using a molding, milling, machining, or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the head 120 may, in certain embodiments, be formed of any of the rigid plastic materials described above as being used for forming the handle 110, although the invention is not to be so limited in all embodiments and other materials that are commonly used during toothbrush head manufacture may also be used.

Figure 2:
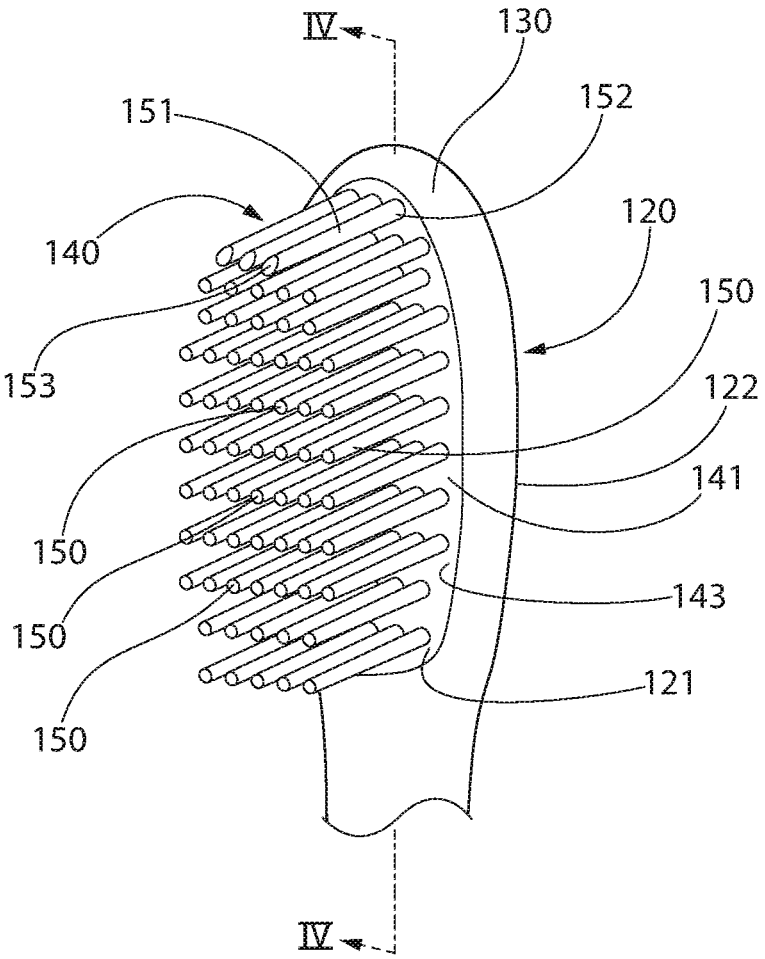
FIG. 2 is a close-up view of the head of the oral care implement of FIG. 1.
Figure 3:
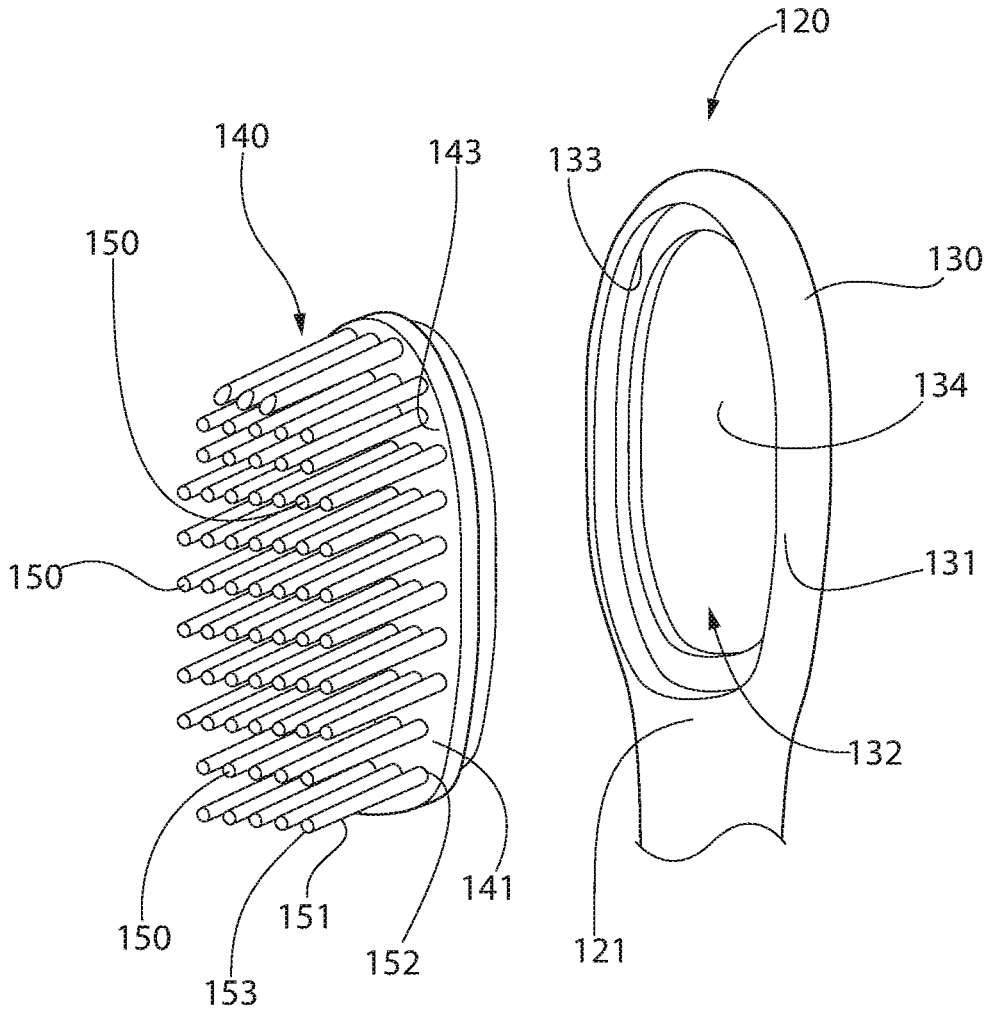
FIG. 3 is an exploded close-up view of the head of the oral care implement of FIG. 2 illustrating a support structure and a monolithic cleaning unit.

Referring to FIGS. 1-3 concurrently, in the exemplified embodiment the head 120 of the oral care implement 100 comprises a support structure 130 and a monolithic cleaning unit 140. The monolithic cleaning unit 140 is coupled to the support structure 130 so that the monolithic cleaning unit 140 and the support structure 130 collectively form the head 120. More specifically, the monolithic cleaning unit 140 generally comprises a base portion 141 that is coupled directly to the support structure 130 and a plurality of bristles 150 extending from the base portion 141. The base portion 141 and all of the plurality of bristles 150 are integrally formed as a single unitary structure (i.e., the monolithic cleaning unit 140). Thus, the monolithic cleaning unit 140 is a one-piece structure that is affixed to the support structure 130. In the exemplified embodiment, the monolithic cleaning unit 140 includes all of the bristles on the head 120. Thus, the head 120 does not include any bristles or other tooth cleaning elements that are not formed as an integral part of the monolithic cleaning unit 140.

Figure 4A:
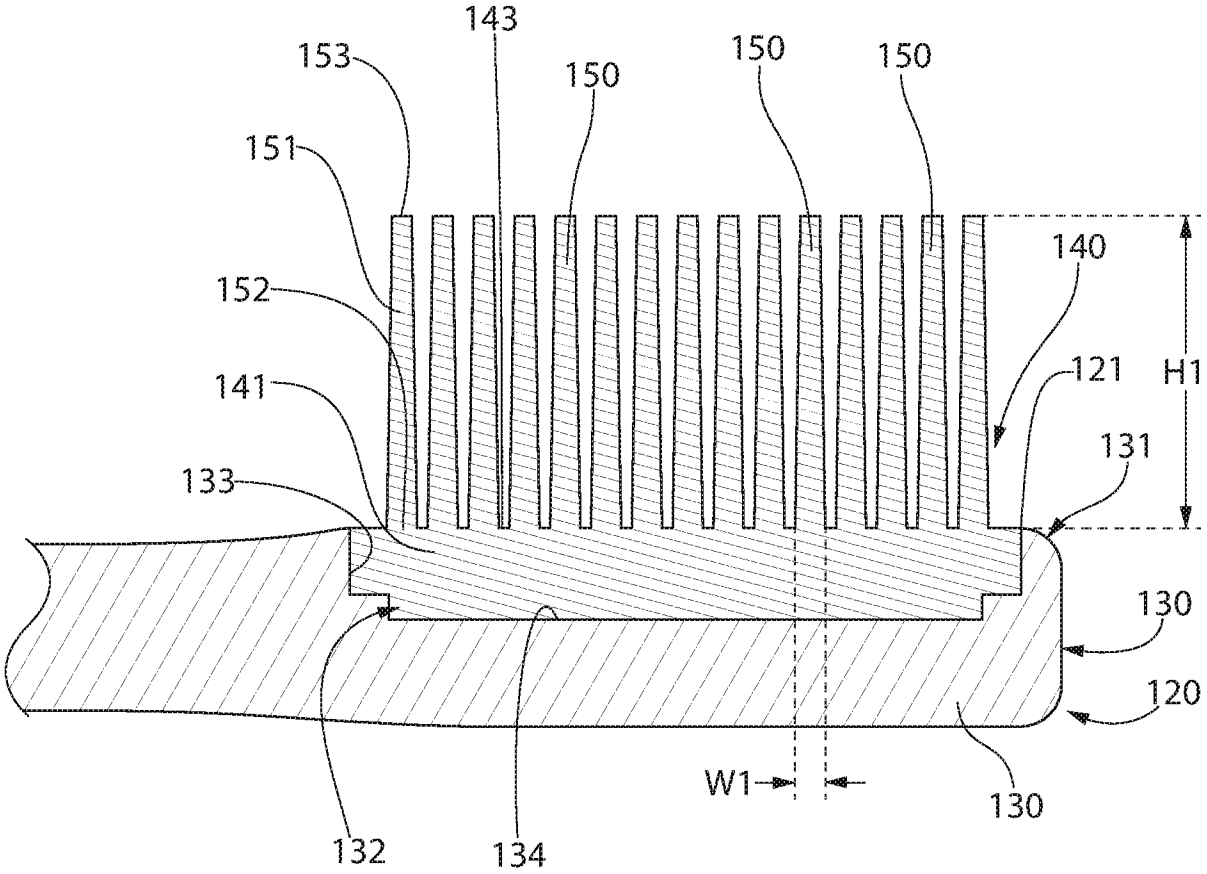
FIG. 4A is a cross-sectional view taken along line IV-IV of FIG. 1.

Referring to FIGS. 3 and 4A concurrently, the structure of the head 120 will be described in more detail. In this embodiment, the support structure 130 comprises a front surface 131 having a basin 132 formed therein. The basin 132 is defined by sidewalls 133 and a floor 134. The basin 132 forms a cavity within which the monolithic cleaning unit 140, and more specifically the base portion 141 of the monolithic cleaning unit 140, may be disposed.

As mentioned above, the monolithic cleaning unit 140 is an integral structure that includes both the base portion 141 and the bristles 150. Thus, all of the bristles 150 and the base portion 141 are formed integrally as a single, unitary, monolithic structure. The monolithic cleaning unit 140 may include between 200 and 250 of the bristles 150 in some embodiments, although more or less of the bristles 150 may be included in other embodiments depending on the surface area or tufting area of the head 120 and the spacing between the bristles 150. In certain embodiments the front surface 121 of the head 120 may comprise a tufting area having a bristle density of between 0.55 and 0.85 bristles per $mm^2$, although other bristle density ranges are possible in alternative embodiments. In some embodiments the head 120 may be devoid of filament bristles extending therefrom. In some embodiments the head comprises 120 tooth cleaning elements that consist only of the plurality of bristles 150 of the monolithic cleaning unit 140. Thus, in such embodiments the only tooth cleaning elements extending from the front surface 121 of the head 120 are the bristles 150 of the monolithic cleaning unit 140.

In certain embodiments the monolithic cleaning unit 140 may be formed via injection molding. Specifically, the support structure 130 of the head 120 may be positioned within a mold cavity, and a material may be injected into the mold cavity to simultaneously form the base portion 141 and the bristles 150 of the monolithic cleaning unit 140 in a single shot. The bristles 150 are preferably solid structures as illustrated in FIG. 4A and not hollow. The monolithic cleaning unit 140 and the bristles 150 thereof may be referred to herein and in the art as injection molded bristles. In certain embodiments, the monolithic cleaning unit 140 may be an integrally formed structure formed of an elastomeric material. The elastomeric material used to form the monolithic cleaning unit 140 may be thermoplastic polyurethane (TPU), thermoplastic elastomer (TPE), silicone, or the like.

In the fully formed head 120 of the embodiment depicted in FIG. 4A, the base portion 141 of the monolithic cleaning unit 140 is positioned within the basin 132 of the support structure 130 and the bristles 150 of the monolithic cleaning unit 140 extend or protrude from the front surface 121 of the head 120 (and also from the front surface 131 of the support structure 130 and from a front surface 143 of the base portion 141 of the monolithic cleaning unit 140). In this embodiment, the monolithic cleaning unit 140 is coupled to the support structure 130 so that the front surface 143 of the base portion 141 of the monolithic cleaning unit 140 is flush with the front surface 131 of the support structure 130. In this way, the front surface 143 of the base portion 141 of the monolithic cleaning unit 140 and the front surface 131 of the support structure 130 collectively form the front surface 121 of the head 120. Of course, the front surface 143 of the base portion 141 of the monolithic cleaning unit 140 need not be flush with the front surface 131 of the support structure 130 in all embodiments and the front surface 143 of the base portion 141 of the monolithic cleaning unit 140 may be recessed relative to or extend beyond the front surface 131 of the support structure 130 in alternative embodiments. In some embodiments the support structure 130 may be omitted and the entire head 120 may be formed from the monolithic cleaning unit 140, which would in such embodiments be coupled directly to the handle 110 of the oral care implement 100.

Figure 4B:
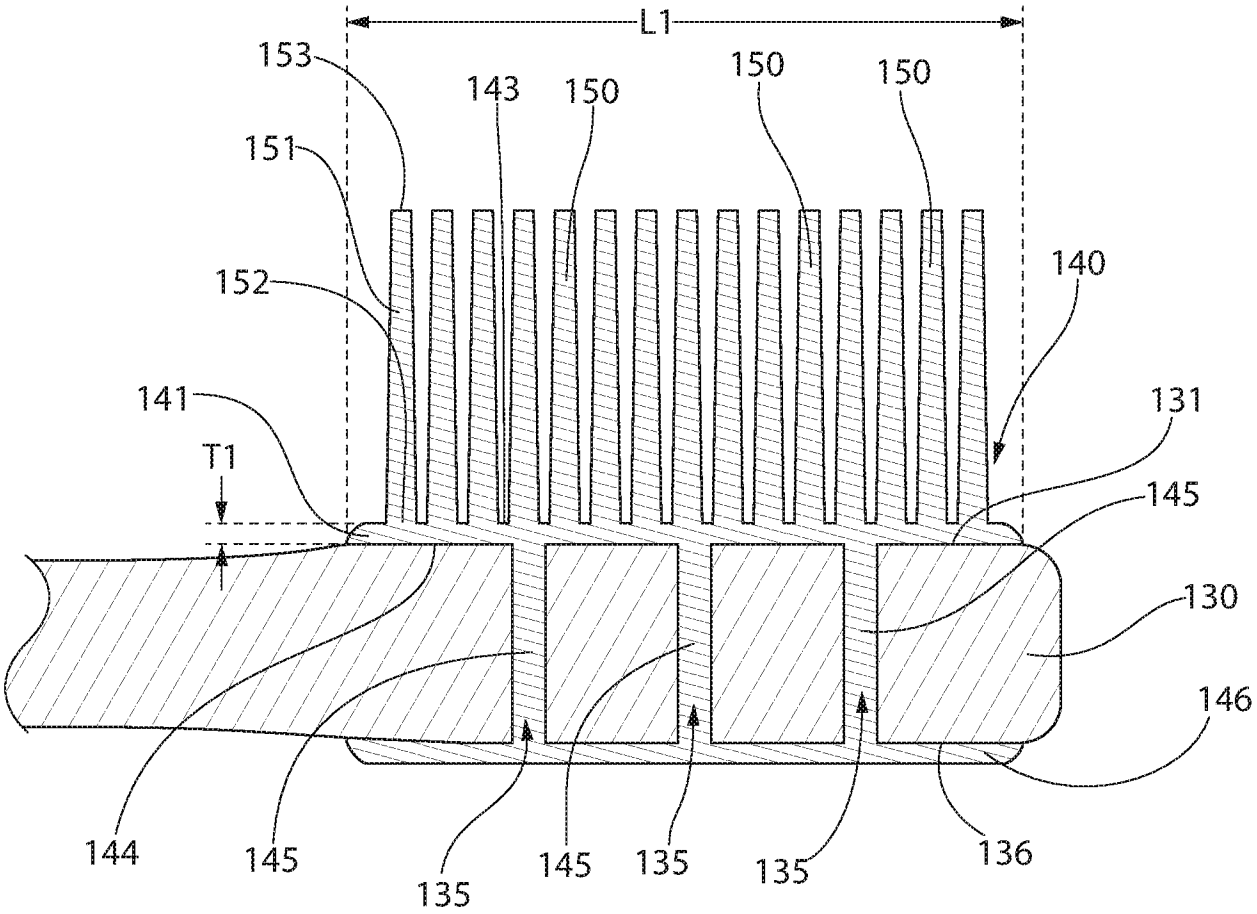
FIG. 4B is an alternative cross-sectional view taken along line IV-IV of FIG. 1.

FIG. 4B illustrates an alternative embodiment wherein the support structure 130 does not have a basin formed therein. Rather, in this embodiment the support structure 130 comprises one or more passageways 135 extending through the support structure 130 from the front surface 131 of the support structure 130 to a rear surface 136 of the support structure 130. In the exemplified embodiment three passageways 135 are illustrated, but more or less than three passageways 135 may be used in other embodiments. In this embodiment, the monolithic cleaning unit 140 comprises the base portion 141 and the bristles 150 extending therefrom. Additionally, the monolithic cleaning unit 140 comprises anchor portions 145 positioned within the passageways 135 of the support structure 130 and a massaging pad 146 disposed on the rear surface 136 of the support structure 130. Although not illustrated, the massaging pad 146 may include protuberances extending therefrom for cleaning a user's tongue and/or soft tissue surfaces during use of the oral care implement 100. Thus, in this embodiment the monolithic cleaning unit 140 may form both bristles for cleaning a user's teeth and a tongue/soft tissue cleaner for cleaning a user's tongue and soft tissue.

In the embodiment of FIG. 4B, the base portion 141 of the monolithic cleaning unit 140 is disposed directly atop of the front surface 131 of the support structure 130. Thus, a rear surface 144 of the base portion 141 is positioned directly atop and in direct surface contact with the front surface 131 of the support structure 130. In certain embodiments, the base portion 141 of the monolithic cleaning unit 140 may have a thickness T1 measured from the rear surface 144 of the base portion 141 of the monolithic cleaning unit 140 to the front surface 143 of the base portion 141 of the monolithic cleaning unit 140 of between 0.5 mm and 1.5 mm, more specifically between 0.6 mm and 1.0 mm, and still more specifically approximately 0.8 mm. Maintaining a low profile and low thickness T1 ensures that the head 120 of the oral care implement 100 will fit comfortably within a user's mouth during toothbrushing. The base portion 141 of the monolithic cleaning unit 140 may have a longitudinal length L1 of between 22 mm and 30 mm, more specifically between 24 mm and 28 mm, and still more specifically approximately 26.6 mm. Of course, thicknesses and longitudinal lengths of the base portion 141 of the monolithic cleaning unit 140 may be outside of the noted ranges in some embodiments.

In the embodiments exemplified in FIGS. 4A and 4B, the front surface 143 of the base portion 141 of the monolithic cleaning unit 140 is exposed at the front surface 121 of the head 120. Stated another way, the front surface 143 of the base portion 141 of the monolithic cleaning unit 140 forms at least a portion of the front surface 121 of the head 120. In certain embodiments the front surface 143 of the base portion 141 of the monolithic cleaning unit 140 may form greater than 80%, or greater than 85%, or greater than 90%, or greater than 95% of the surface area of the front surface 121 of the head 120. In some embodiments the front surface 131 of the support structure 130 forms a perimeter portion of the front surface 121 of the head 120 and the front surface 143 of the base portion 141 of the monolithic cleaning unit 140 forms an interior portion of the front surface 121 of the head 120 that is substantially, or entirely, surrounded by the front surface 131 of the support structure 130. In other embodiments, the front surface 143 of the base portion 141 of the monolithic cleaning unit 140 may form the entire front surface 121 of the head 120.

In some embodiments, the monolithic cleaning unit 140 may also extend over the distal end of the support structure 130. In such an embodiment, the passageways 135 may be included or omitted as desired. Specifically, the passageways 135 are used in the exemplified embodiment in order to securely couple the monolithic cleaning unit 140 to the support structure 130. However, if the monolithic cleaning unit 140 extends over the front and rear surfaces 131, 136 of the support structure 130 and also over the distal end of the support structure 130, such passageways may not be needed to achieve the coupling of the monolithic cleaning unit 140 to the support structure 130. Other techniques for ensuring a secure coupling between the monolithic cleaning unit 140 and the support structure 130 are within the scope of the present invention, such as using various combinations of interlocking features on the monolithic cleaning unit 140 and the support structure 130.

Figure 5:
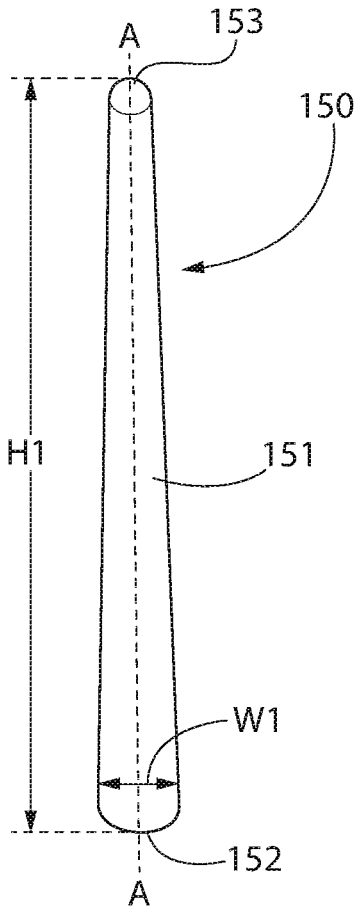
FIG. 5 is a perspective view of a bristle of the monolithic cleaning unit in accordance with an embodiment of the present invention.

In the embodiment exemplified in FIGS. 1-4B, the bristles 150 of the monolithic cleaning unit 140 are all in the shape of a tapered cylinder having smooth outer surfaces. One exemplary embodiment of the bristles 150 is illustrated in FIG. 5. Specifically, the bristles 150 may have a tapered cylinder shape (also known as a truncated cone or a frustocone). Thus, in the embodiment exemplified in FIGS. 1-5, the bristles 150 comprise a body 151 that extends along a longitudinal axis A-A from a proximal end 152 that is adjacent to or in contact with or that extends directly from the base portion 141 of the monolithic cleaning unit 140 to a distal end 153 that is spaced from the front surface 121 of the head 120. In this embodiment, the body 151 is cylindrical (round, oval, tapered), conical, or the like. The distal end 153 of the bristle 150 may be flat, rounded, tapered, slanted, or the like as desired to achieve different cleaning benefits.

Although the bristles 150 are illustrated herein as comprising a body 151 having a cylindrical or conical shape (with a round or oval transverse cross-sectional shape), the invention is not to be so limited in all embodiments. When the body 151 has a cylindrical shape, this may include oval cylinders, tapered cylinders, cones, truncated cones, frustoconical shaped structures, or the like. Furthermore, in some embodiments the body 151 of the bristles 150 may have a shape that is not cylindrical or round, such as having triangular, square, rectangular, or other polygonal shaped transverse cross-sections. Thus, the body 151 of the bristles 150 may be cylindrical, conical, or prism-shaped and the body 151 may be tapered. Examples of some non-cylindrical shaped bristles (i.e., prism-shaped) are illustrated in FIGS. 10A-10C and described below. Various combinations of the different bristles described in FIGS. 5-11E may be included on the head 120 of the oral care implement 100. Specifically, various combinations of the different bristles described in FIGS. 5-11E may form the bristles 150 of the monolithic cleaning unit 140. In some embodiments all of the bristles on the head 120 of the oral care implement 100 are identical in structure. In other embodiments, different ones of the bristles described herein may form part of the monolithic cleaning unit 140 and be provided on the same head 120.

Referring to FIGS. 4A and 5, in certain embodiments the bristles 150 may have a maximum width W1 of between 0.6 mm and 1.0 mm, and more specifically approximately 0.8 mm. Furthermore, the bristles 150 may have a height H1 of between 10 mm and 14 mm, and more specifically between 11 mm and 12 mm. In certain embodiments, a ratio of the height H1 of the bristles 150 to the width W1 of the bristles 150 may be between 8:1 and 20:1, or more specifically between 10:1 and 15:1, and still more specifically between 12:1 and 15:1 or between 13:1 and 15:1. This height to width ratio for the bristles 150 may be applicable to all embodiments of the bristles described herein, including those illustrated in FIGS. 6A-11E. All of the bristles 150 of the monolithic cleaning unit 140 may have the same height as illustrated in FIGS. 4A and 4B or they may have varying heights. As noted above, in the embodiment exemplified in FIG. 5, the bristles 150 have a tapered cylindrical shape. Thus, the maximum width W1 of the bristles 150 is the width of the bristles 150 at the proximal end 152. The width and the cross-sectional area of the bristles 150 decreases with distance from the proximal end 152 towards the distal end 153.

In FIGS. 1-4B, the bristles 150 are illustrated having a cylindrical or conical shape similar to the bristle 150 of FIG. 5. However, the invention is not to be so limited in all embodiments and the bristles that form a part of the monolithic cleaning unit 140 may include the bristles 150 alone, the bristles 150 along with other bristles, or may just include other types of bristles as described herein below with reference to FIGS. 6-11E. Thus, any combination of the different types of bristles described herein can form an integral part of the monolithic cleaning unit 140 of the head 120 of the oral care implement 100.

Figure 6A:
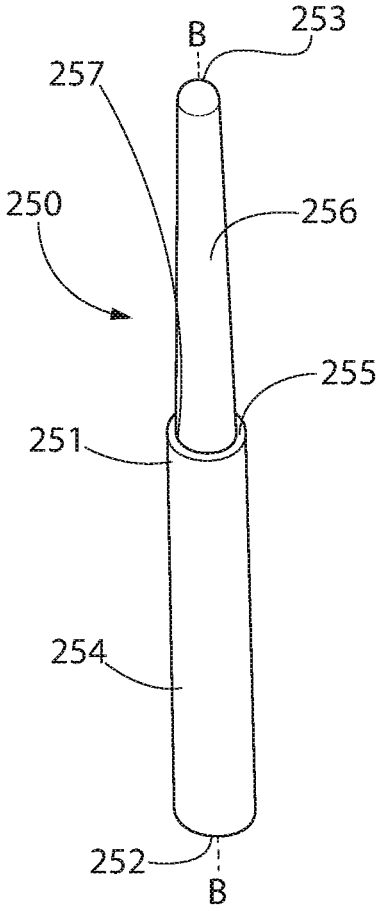
FIGS. 6A-6B are perspective views of bristles of in accordance with another embodiment of the present invention.
Figure 6B:
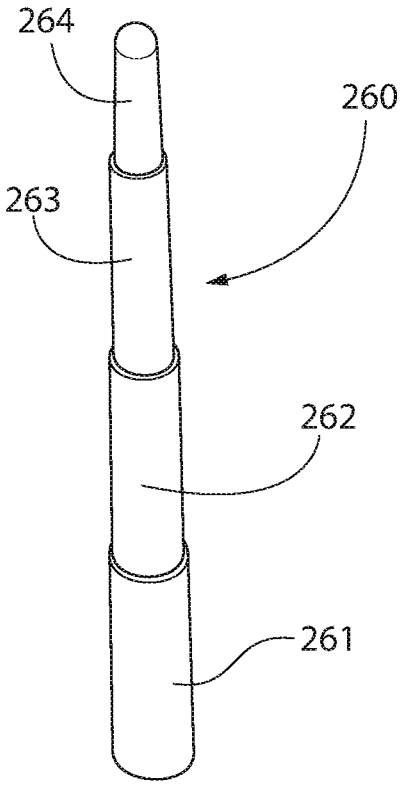

Referring to FIGS. 6A and 6B, a bristle 250 is illustrated in accordance with an embodiment of the invention. In some embodiments, one, or a plurality, of the bristles 250 may be formed as an integral part of the monolithic cleaning unit 140. Specifically, the monolithic cleaning unit 140 may include the base portion 141 and one or a plurality of the bristles 250. Alternatively, the monolithic cleaning unit 140 may include the base portion 141 and a combination of the bristles 150, 250, and the other bristles described herein below.

Referring first to FIG. 6A, the bristle 250 comprises a body 251 that extends from a proximal end 252 to a distal end 253 along a longitudinal axis B-B. In this embodiment, the body 251 comprises a first longitudinal section 254 that extends from the proximal end 252 of the body 251 to a distal end 255 of the first longitudinal section 254 and a second longitudinal section 256 that extends from a proximal end 257 of the second longitudinal section 256 to the distal end 253 of the body 251. The first and second longitudinal sections 254, 256 form a stepped surface because the second longitudinal section 256 has an immediately reduced cross-sectional area relative to the first longitudinal section 254 at the intersection of the first and second longitudinal sections 254, 256. Specifically, the first longitudinal section 254 has a minimum cross-sectional area that is greater than a maximum cross-sectional area of the second longitudinal section 256. More specifically, the first longitudinal section 254 has a cross-sectional area at the distal end 255 of the first longitudinal section 254 that is greater than the cross-sectional area of the second longitudinal section 256 taken at the proximal end 257 of the second longitudinal section 256. The distal end 255 of the first longitudinal section 254 forms an annular shoulder or flange that protrudes radially from the proximal end 257 of the second longitudinal section 256. This annular shoulder or flange forms an additional surface or edge for contacting and cleaning a user's oral surfaces.

In certain embodiments, the first longitudinal section 254 may have a constant cross-sectional area along its length from the proximal end 252 of the body 251 to the distal end 255 of the first longitudinal section 254. In other embodiments, the cross-sectional area of the first longitudinal section 254 may decrease from the proximal end 252 of the body 251 to the distal end 255 of the first longitudinal section 254. In the exemplified embodiment, the cross-sectional area of the second longitudinal section 256 decreases from the proximal end 257 of the second longitudinal section 256 to the distal end 253 of the body 251 such that the second longitudinal section 256 tapers along its entire length. The thicker first longitudinal section 254 provides rigidity to the bristle 250 whereas the thinner second longitudinal section 256 can flex and move more readily during toothbrushing.

Referring to FIG. 6B, an alternate embodiment of a bristle 260 is illustrated. In this embodiment, the bristle 260 has a first longitudinal section 261, a second longitudinal section 262, a third longitudinal section 263, and a fourth longitudinal section 264. Each longitudinal section 261-264 may have a constant cross-sectional area or a gradually decreasing cross-sectional area (moving from the proximal end to the distal end of the respective sections). The transition between the adjacent longitudinal sections 261-264 is formed by an abrupt change in the cross-sectional area of the bristle 260, such as was described above with regard to FIG. 6A, so that an annular flange or shoulder is formed between each of the adjacent longitudinal sections 261-264. The bristle 260 will have different resiliencies/flexibilities along its length as the cross-sectional area within each longitudinal section 261-264 decreases.

Referring to FIGS. 7A-7D concurrently, several permutations of a bristle 350 are illustrated and will be described. The bristle 350 is similar to the bristle 150 described above except as described in detail below. Thus, the bristle 350, or a plurality of the bristles 350, may be formed as an integral part of the monolithic cleaning unit 140. The monolithic cleaning unit 140 may include only the bristles 350 or a combination of the bristles 350 along with the bristles 150, 250 described above and other bristles to be described later on in this document. Certain features of the bristles 350 are the same as described above with regard to the bristles 150 of FIGS. 1-5 and thus a similar numbering scheme will be used except the 300-series of numbers will be used to describe the bristles 350. It should be appreciated that the description of certain features of the bristles 150 may be applicable to the bristles 350 even though such features are not described in great detail below with regard to the bristles 350.

The bristle 350 comprises a body 351 that extends along a longitudinal axis C-C from a proximal end 352 to a distal end 353. The proximal end 352 of the bristle 350 is adjacent to and connected directly to the base portion 141 of the monolithic cleaning unit 140 as described above with regard to the bristles 150. The body 351 of the bristle 350 comprises an outer surface 354. In this embodiment, the body 351 of the bristle 350 is in the shape of a tapered cylinder, although other shapes are possible as discussed in detail above. Thus, the body 351 has a circular or oval (i.e., round) transverse cross-sectional shape and the cross-sectional area of the body 351 decreases with distance from the proximal end 352 towards the distal end 353.

Figures 7A, 7B, 7C, 7D:
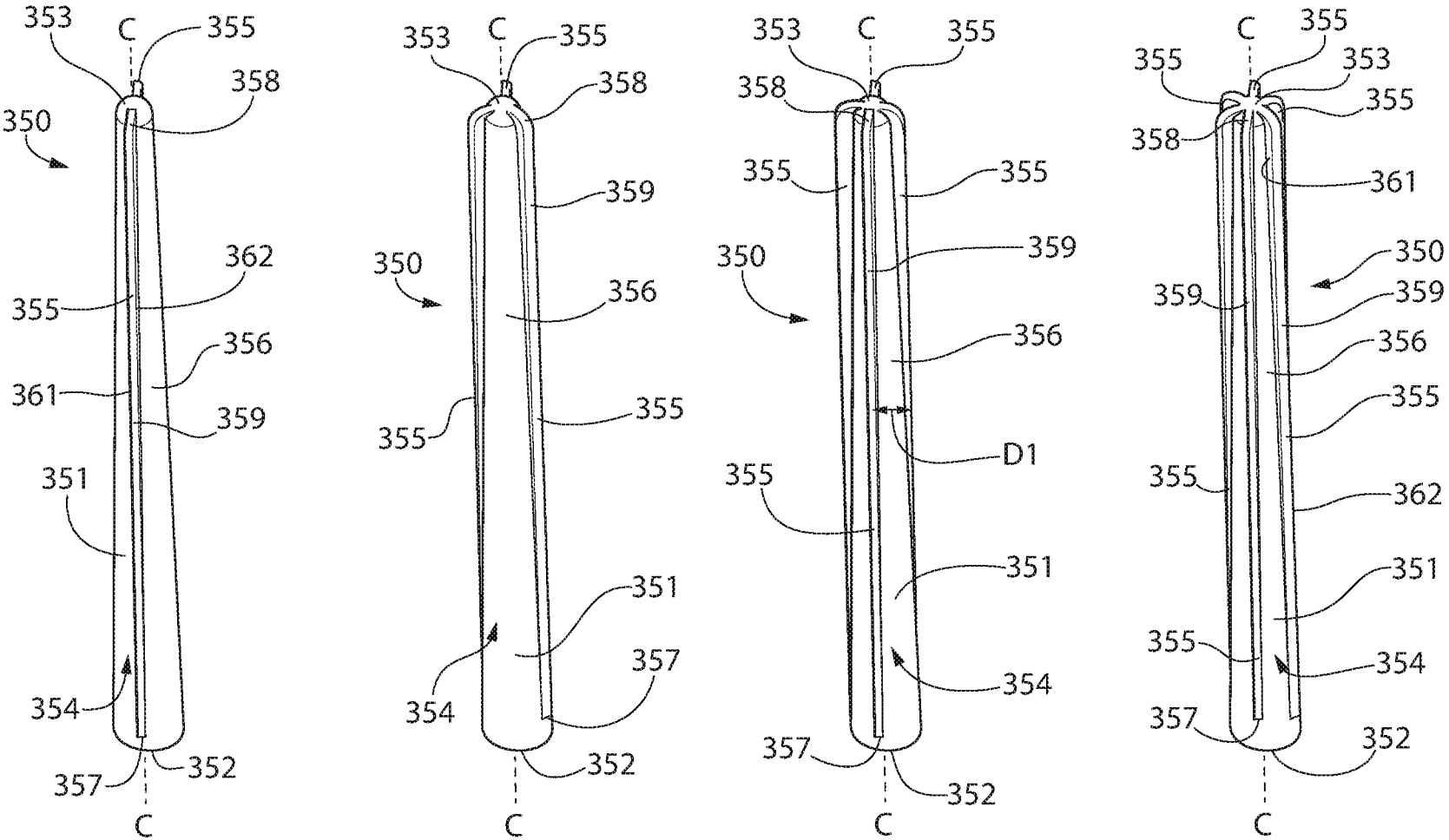
FIGS. 7A-7D are perspective views of bristles in accordance with yet another embodiment of the present invention.

The bristle 350 also comprises one, or a plurality, of longitudinally elongated ribs 355 extending from the outer surface of the body 351. In the embodiment of FIG. 7A, the bristle 350 comprises two of the longitudinally elongated ribs 355. In the embodiment of FIG. 7B, the bristle 350 comprises three of the longitudinally elongated ribs 355. In the embodiment of FIG. 7C, the bristle 350 comprises four of the longitudinally elongated ribs 355. In the embodiment of FIG. 7D, the bristle 350 comprises five of the longitudinally elongated ribs 355. Although multiple longitudinally elongated ribs 355 are illustrated in each embodiment exemplified herein, a single longitudinal rib 355 may also be used.

In each of the embodiments depicted in FIGS. 7A-7D, the bristle 350 comprises a plurality of the longitudinally elongated ribs 355 extending from the outer surface 354 of the body 351 of the bristle 350. In certain embodiments, the longitudinally elongated ribs 355 may extend radially outward from the outer surface 354 of the body 351 of the bristle 350. The longitudinally elongated ribs 355 extend vertically along a portion of or the entirety of the length of the bristle 350 between the proximal and distal ends 352, 353 of the bristle 350 in a longitudinal direction (i.e., in a direction of the longitudinal axis C-C). The longitudinally elongated ribs 355 extend from the outer surface 354 of the body 351 in a circumferentially spaced apart manner. Thus, circumferential portions 356 (only some of which are labeled in the drawings to avoid clutter) of the outer surface 354 of the body 351 located between adjacent ones of the longitudinally elongated ribs 355 are exposed along an entire length of the body 351. In the exemplified embodiment, the circumferential distance between two adjacent ones of the longitudinally elongated ribs 355 decreases from the proximal end 352 of the body 351 to the distal end 353 of the body 351 due to the tapering shape of the body 351.

In this embodiment, each of the longitudinally elongated ribs 355 extends from a bottom end 357 located near the proximal end 352 of the body 351 to a top end 358 located at the distal end 353 of the body 351. More specifically, the bottom ends 357 of the longitudinally elongated ribs 355 are spaced a distance from the proximal end 352 of the body 351. The top ends 358 of the longitudinally elongated ribs 355 are positioned at the distal end 353 of the body 351 and are not spaced therefrom. The body 351 has a length measured from the proximal end 352 to the distal end 353 and the longitudinally elongated ribs 355 extend along a majority of the length of the body 351. In certain embodiments a ratio of the length of the body 351 to a length of the longitudinally elongated ribs 355 is between 1.1:1 and 1.5:1.

In the exemplified embodiment, each of the longitudinally elongated ribs 355 is a somewhat thin member extending from the outer surface 354 of the body 351 of the bristle 350. Specifically, the longitudinally elongated ribs 355 comprise first and second sidewalls 361, 362 that extend directly from the outer surface 354 of the body 351 of the bristle 350 and a terminal edge 359. The first and second sidewalls 361, 362 terminate at the terminal edge 359, which extends between the first and second sidewalls 361, 362. The terminal edge 359 is spaced a distance from the outer surface 354 of the body 351 to form a height of the longitudinally elongated rib 355. In certain embodiments, a greater surface area of the outer surface 354 of the body 351 of the bristle 350 is smooth and free of the longitudinally elongated ribs 355 than the surface area of the outer surface 354 of the body 351 taken up by the longitudinally elongated ribs 355.

In this embodiment, the body 351 of the bristle 350 tapers from the proximal end 352 to the distal end 353. Stated another way, the transverse cross-sectional area of the body 351 gradually (and in certain embodiments continuously) decreases as the body 351 extends from the proximal end 352 to the distal end 353. Furthermore, as the body 351 tapers towards the distal end 353, the longitudinally elongated ribs 355 extend further from the outer surface 354 of the body 351 the closer they get to the distal end 353 of the body 351. Specifically, the longitudinally elongated ribs 355 comprise the terminal edge 359, which is the edge of the longitudinally elongated ribs 355 located furthest from the outer surface 354 of the body 351. A height of the longitudinally elongated ribs 355 measured from the outer surface 354 of the body 351 to the terminal edge 359 of the longitudinally elongated ribs 355 increases along a length of the longitudinally elongated ribs 355 from the bottom end 357 of the longitudinally elongated ribs 355 to the top end 358 of the longitudinally elongated ribs 355. Thus, the longitudinally elongated ribs 355 extend a greater height from the outer surface 354 of the body 351 towards the top end 358 of the longitudinally elongated ribs 355 than the bottom end 357 of the longitudinally elongated ribs 355.

Although the height of the longitudinally elongated ribs 355 relative to the outer surface 354 of the body 351 increases towards the top end 358 of the longitudinally elongated ribs 355, this is due primarily (or entirely) to the tapering of the body 351. Thus, a distance D1 measured from the longitudinal axis C-C of the body 351 to the terminal edge 359 of the longitudinally elongated ribs 355 is substantially constant along the entire length of the longitudinally elongated ribs 355. As a result, the terminal edge 359 of the longitudinally elongated ribs 355 extend along an axis or plane that is parallel to the longitudinal axis C-C of the body 351.

In the exemplified embodiment, the height that the longitudinally elongated ribs 355 extend from the outer surface 354 of the body 351 is greater than the width of the terminal edge 359 of the longitudinally elongated ribs 355 measured between the opposing first and second sidewalls 361, 362. In other embodiments, the width of the terminal edge 359 and a maximum height that the longitudinally elongated ribs 355 extends from the outer surface 354 of the body 351 is nearly the same. In certain embodiments the maximum height of the longitudinally elongated ribs 355 and the width of the terminal edges 359 of the longitudinally elongated ribs 355 may be less than 0.5 mm. In certain embodiments the maximum height of the longitudinally elongated ribs 355 is between 0.4 mm and 0.5 mm, and more specifically approximately 0.45 mm, and the width of the terminal edge 359 may be less than 0.4 mm, less than 0.3 mm, or less than 0.2 mm. While the height of the longitudinally elongated ribs 355 may change along the length of the body 351, the width of the longitudinally elongated ribs 355 may be constant along the length of the longitudinally elongated ribs 355. In some embodiments, a ratio of the maximum width of the body 351 of the bristle 350 to the maximum height of the longitudinally elongated ribs 355 may be between 1.1:1 to 4:1, more specifically between 1.4:1 and 3:1, and still more specifically between 1.6:1 and 1.9:1.

Referring to FIGS. 8A-8D, another embodiment of a bristle 450 will be described in accordance with the present invention. The bristle 450 is similar to the bristle 350 described above and thus similar numbering will be used. Only the features of the bristle 450 that are different than the features of the bristle 350 described above will be described in detail herein below. Thus, it should be appreciated that the description of the bristle 350 is applicable to the bristle 450 except as described below. The bristle 450 will be described using a similar numbering scheme to the bristle 350 except that the 400-series of numbers will be used. The bristle 450, or a plurality of the bristles 450, may form an integral part of the monolithic cleaning unit 140 as has been discussed above.

The bristle 450 comprises a body 451 that extends from a proximal end 452 to a distal end 453 along a longitudinal axis D-D. The body 451 has an outer surface 454. The body 451 tapers along its length as it extends from the proximal end 452 towards the distal end 453. Furthermore, one, or a plurality of, longitudinally elongated ribs 455 extend or protrude from the outer surface 454 of the body 451. As illustrated in FIGS. 8A-8D, the bristle 450 may include one, two, three, four, five, or more of the longitudinally elongated ribs 455 extending therefrom in a circumferentially spaced apart manner. The longitudinally elongated ribs 455 extend from a bottom end 457 that is adjacent to and spaced from the proximal end 452 of the body 451 to a top end 458 that is adjacent to and spaced from the distal end 453 of the body 451. Thus, the main difference between the bristle 450 and the bristles 350 described above is that the top end 458 of the longitudinally elongated ribs 455 are spaced below rather than positioned at the distal end 453 of the body 451.

Thus, in this embodiment the body 451 of the bristle 450 comprises a tip portion 460 that is free of the longitudinally elongated ribs 455. Stated another way, the longitudinally elongated ribs 455 terminate at a distance below the distal end 453 of the bristle 450. The space between the top ends 458 of the longitudinally elongated ribs 455 and the distal end 453 of the bristle 450 is free of the ribs or other features extending therefrom. Thus, the tip portion 460 of the bristle 450 may be smooth along its entire circumference. This permits the tip portion 460 of the bristle 450 to be capable of penetrating into the interproximal tooth spaces during cleaning without interference by the longitudinally elongated ribs 455.

Referring to FIGS. 9A-9D, another embodiment of a bristle 550 that may form an integral part of the monolithic cleaning unit 140 will be described in accordance with the present invention. The bristle 550 is similar to the bristle 250 described above with regard to FIG. 6A and the bristle 350 described above with regard to FIGS. 7A-7D and thus similar numbering will be used. Only the features of the bristle 550 that are different than the features of the bristle 250, 350 described above will be described in detail herein below. Thus, it should be appreciated that the description of the bristles 250, 350 is applicable to the bristle 550 except as described below. The bristle 550, or a plurality of the bristles 550, may form an integral part of the monolithic cleaning unit 140 as has been discussed above.

The bristle 550 comprises a body 551 that extends from a proximal end 552 to a distal end 553 along a longitudinal axis E-E. The body 551 comprises an outer surface 554. One or more longitudinally elongated ribs 555 extend or protrude from the outer surface 554 in much the same way as described above. However, in this embodiment the body 551 comprises a first longitudinal section 561 that extends from the proximal end 552 of the body 551 to a distal end 562 of the first longitudinal section 561 and a second longitudinal section 563 that extends from a proximal end 564 to the distal end 553 of the body 551. Similar to the discussion of FIG. 6A, the first longitudinal section 561 has a minimum cross-sectional area that is greater than a maximum cross-sectional area of the second longitudinal section 563. More specifically, the distal end 562 of the first longitudinal section 561 has a greater cross-sectional area than the proximal end 564 of the second longitudinal section 563, thereby forming an annular flange at the distal end 562 of the first longitudinal section 561. The bristle 550 may include additional longitudinal sections such as illustrated in FIG. 6B. As with the previously described embodiments and as shown in FIGS. 9A-9D, there may be one, two, three, four, five, or more of the longitudinally elongated ribs 555 extending from the body 551.

In this embodiment, the longitudinally elongated ribs 555 are located entirely on the second longitudinal section 563 and the first longitudinal section 561 is completely devoid of any of the ribs. Thus, in this embodiment the first longitudinal section 561 comprises a smooth outer surface 554 that is free of protuberances extending therefrom or indents formed therein. Specifically, the longitudinally elongated ribs 555 extend from a bottom end 557 to a top end 558. In the exemplified embodiment, the bottom ends 557 of the longitudinally elongated ribs 555 are in contact with the distal end 562 of the first longitudinal section 561. Thus, the longitudinally elongated ribs 555 extend upwardly from the annular shoulder or flange formed by the distal end 562 of the first longitudinal section 561 and outwardly from the outer surface 554 of the body 551 along the second longitudinal section 563 of the body 561. The longitudinally elongated ribs 555 extend along the second longitudinal section 563 from the proximal end 564 of the second longitudinal section 563 to the top end 558 of the longitudinally elongated ribs 555, which in the exemplified embodiment is positioned below the distal end 553 of the bristle 550.

Of course, in other embodiments the longitudinally elongated ribs 555 may extend to the distal end 553 of the body 551. Alternatively, the longitudinally elongated ribs 555 may be positioned entirely on the first longitudinal section 561 such that the second longitudinal section 563 is devoid of the longitudinally elongated ribs 555. This may permit the first longitudinal section 561 with the longitudinally elongated ribs 555 thereon to perform a wiping cleaning action while the second longitudinal section 563 performs a more region-specific and interproximal cleaning. In the exemplified embodiment, a terminal edge 559 of the longitudinally elongated ribs 555 extends the same distance from the longitudinal axis E-E as the outer surface 554 of the body 551 in the first longitudinal section 561. Thus, the longitudinally elongated ribs 555 do not extend radially beyond the outer surface 554 of the body 551 in the first longitudinal section 561.

Referring to FIGS. 10A-10C, another embodiment of a bristle 650 that may form an integral part of the monolithic cleaning unit 140 will be described in accordance with the present invention. The bristle 650 or a plurality of the bristles 650 may be used on the head 120 as a part of the monolithic cleaning unit 140 as has been described above. The bristle 650 is similar to the bristles 450 described above with reference to FIGS. 8A-8D except with regard to the shape of the body 651. Specifically, in FIGS. 8A-8D the body 451 is cylindrical, tapered cylindrical, conical, frusto-conical, or the like. In FIGS. 10A-10C, the body 651 of the bristle 650 has different non-circular shapes (i.e., prism shapes).

Specifically, in FIG. 10A the body 651 of the bristle 650 has a triangular cross-sectional shape. In FIG. 10B the body 651 of the bristle 650 has a square or rectangular cross-sectional shape. In FIG. 10C, the body 651 of the bristle 650 has a hexagonal cross-sectional shape. Thus, FIGS. 10A-10C provide exemplary embodiments of the bristle 650 having shapes that are non-cylindrical. In each of these embodiments, a plurality of longitudinally elongated ribs 655 extend from the outer surface 654 of the body 651. The longitudinally elongated ribs 655 may protrude from edges formed on the outer surface 654 (see FIGS. 10A and 10B) or from the surfaces formed between the edges on the outer surface 654 (see FIG. 10C). Although only triangles, squares, and hexagons are depicted as possibilities for the cross-sectional shapes of the body 651 of the bristle 650, other polygonal shapes are possible. Using a polygonal shape for the body 651 of the bristle 650 and having the longitudinally elongated ribs 655 protruding therefrom provides additional edges for teeth and soft tissue surface cleaning.

Referring to FIGS. 11A-11E, versions of the bristles described herein above having a spiral or helical rib rather than a longitudinally elongated rib will be described.

Figures 11A, 11B, 11C, 11D, 11E:
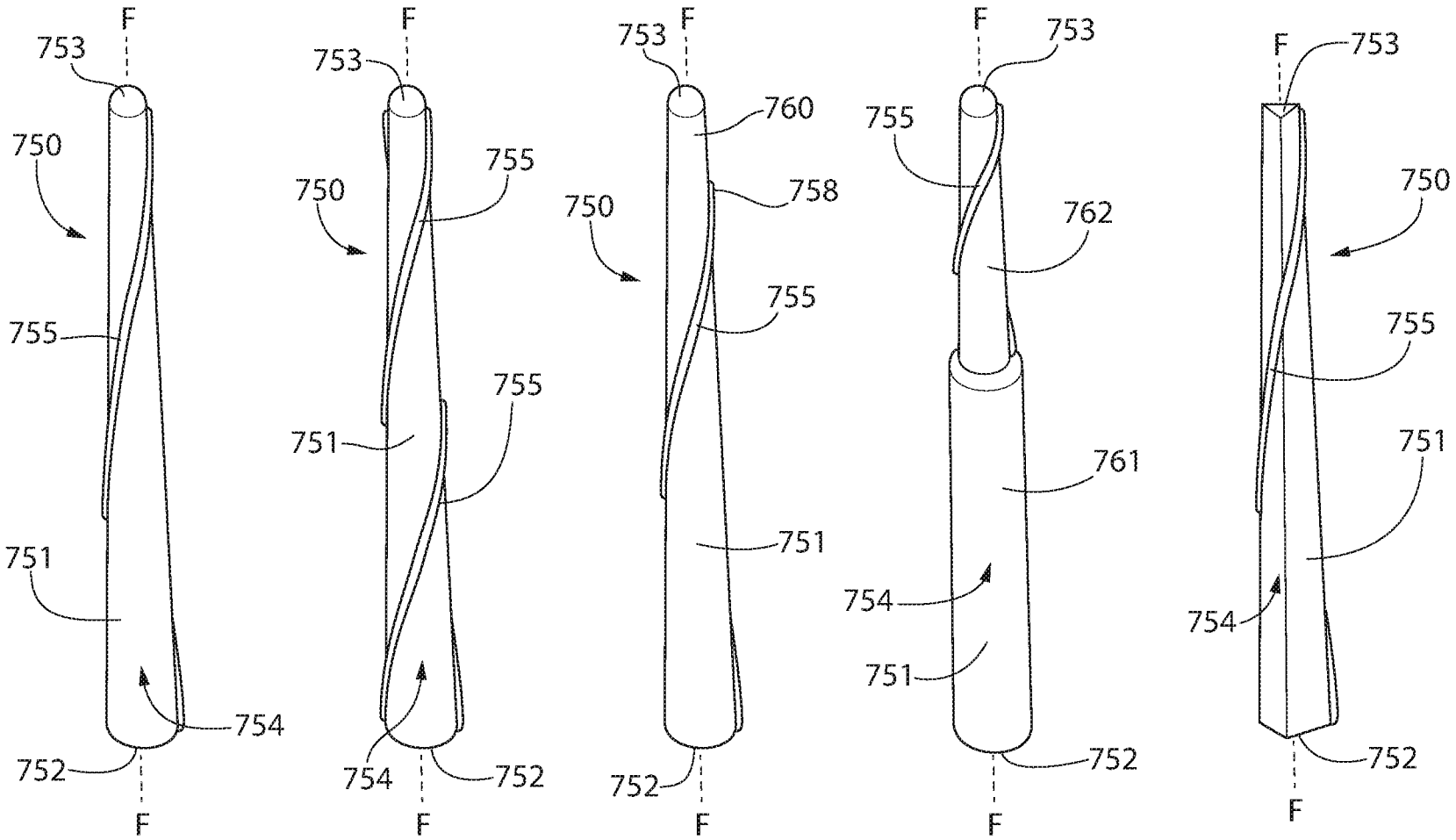
FIGS. 11A-11E are perspective views of bristles in accordance with another embodiment of the present invention.

Referring first to FIG. 11A, a bristle 750 that may form an integral part of the monolithic cleaning unit 140 will be described in accordance with the present invention. The bristle 750 is identical to the bristle 350 of FIG. 7A except that instead of the rib being longitudinally elongated, it is spiral or helical. A numbering scheme similar to that used to describe the bristle 350 will be used to describe the bristle 750 except that the 700-series of numbers will be used. It should be appreciated that certain features of the bristle 350 that were described above and that are not described in detail with regard to the bristle 750 for brevity are nonetheless applicable to the bristle 750.

Specifically, the bristle 750 comprises a body 751 that extends from a proximal end 752 to a distal end 753 along a longitudinal axis F-F. The proximal end 752 of the body 751 is the portion that is coupled to the base portion 141 of the monolithic cleaning unit 140 and the distal end 753 of the body 751 is the portion that is spaced from the head 120 of the oral care implement 100. The body 751 of the bristle 750 comprises an outer surface 754. Furthermore, as discussed above with regard to the bristle 350, the body 751 of the bristle 750 tapers along its length from the proximal end 752 to the distal end 753 such that the transverse cross-sectional area of the body 751 decreases with distance from the proximal end 752 towards the distal end 753.

Furthermore, the bristle 750 comprises a rib 755 extending from the outer surface 754 of the body 751. However, as noted above, the rib 755 is a spiral rib rather than a longitudinally elongated rib. Thus, the rib 755 extends from the outer surface 754 of the body 751 in a helical manner about the longitudinal axis F-F. Stated another way, the rib 755 is wound around the body 751 as it extends from the proximal end 752 of the body 751 to the distal end 753 of the body 751.

FIG. 11B illustrates a modified version of the bristle 750 of FIG. 11A that includes two of the ribs 755 extending from the outer surface 754 of the body 751 of the bristle 750 in a helical manner about the longitudinal axis F-F. In this embodiment, the two ribs 755 are spaced apart from one another along the entire length of the ribs 755. Other embodiments are possible that use more than two of the helical or spiral ribs 755 as should be appreciated by persons skilled in the art.

Figures 8A, 8B, 8C, 8D:
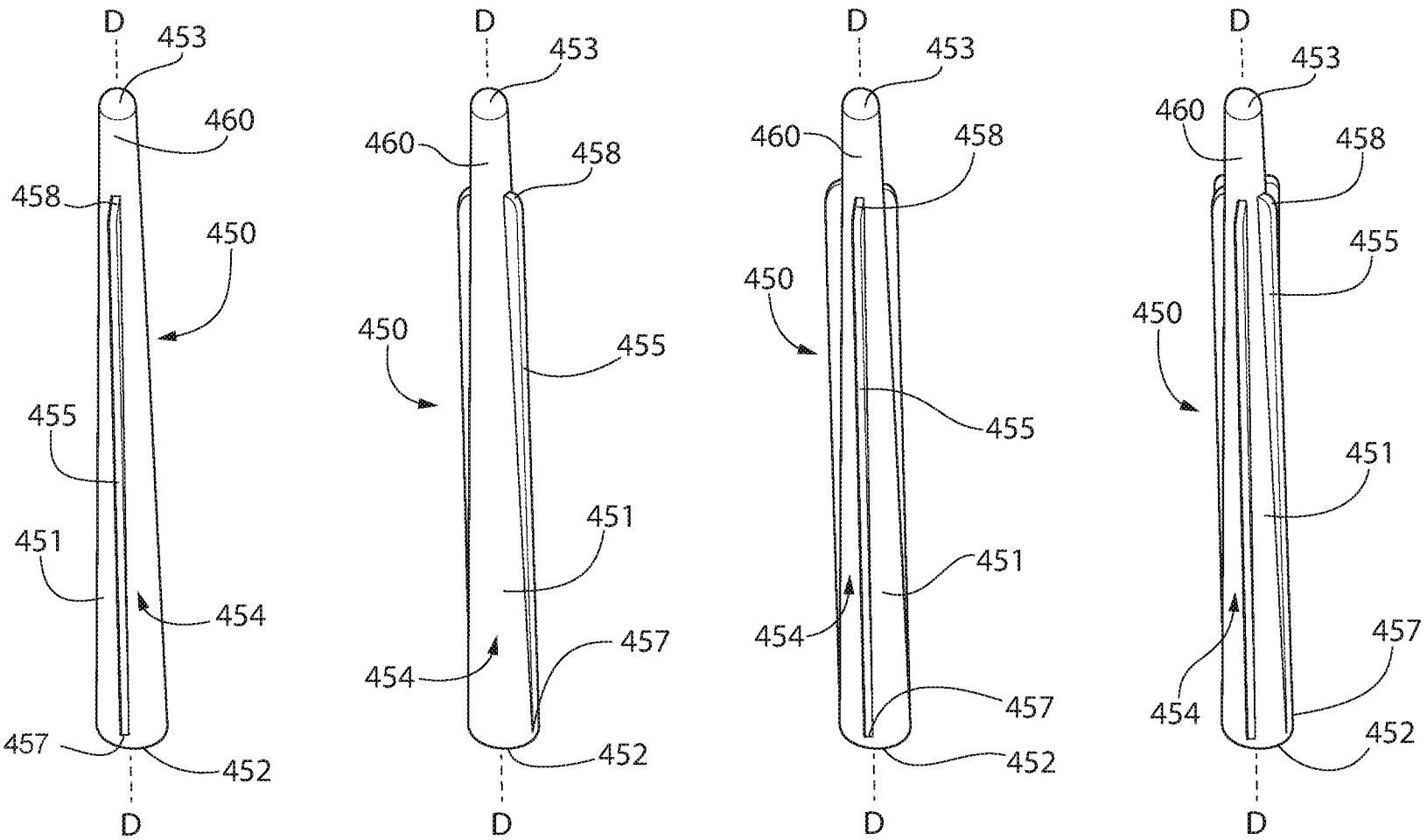
FIGS. 8A-8D are perspective views of bristles in accordance with still another embodiment of the present invention.

FIG. 11C illustrates another modified version of the bristle 750 of FIG. 11A that is similar to the bristle 450 of FIG. 8A in that the rib 755, which extends in a helical manner about the longitudinal axis F-F, does not extend all the way to the distal end 753 of the body 751. Rather, the top end 758 of the rib 755 is spaced from the distal end 753 of the body 751 so that a tip portion 760 of the bristle 750 is formed that is free of the rib(s) 755.

Figure 9D:
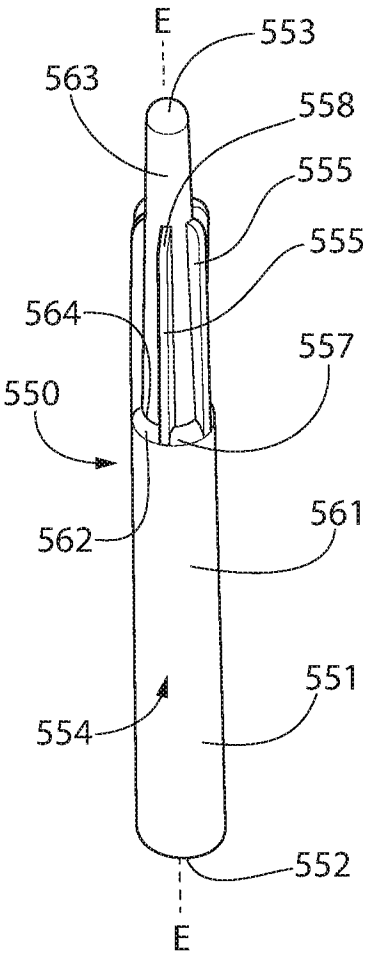
FIG. 9A-9D is a perspective view of a bristle in accordance with a further embodiment of the present invention.
Figure 9C:
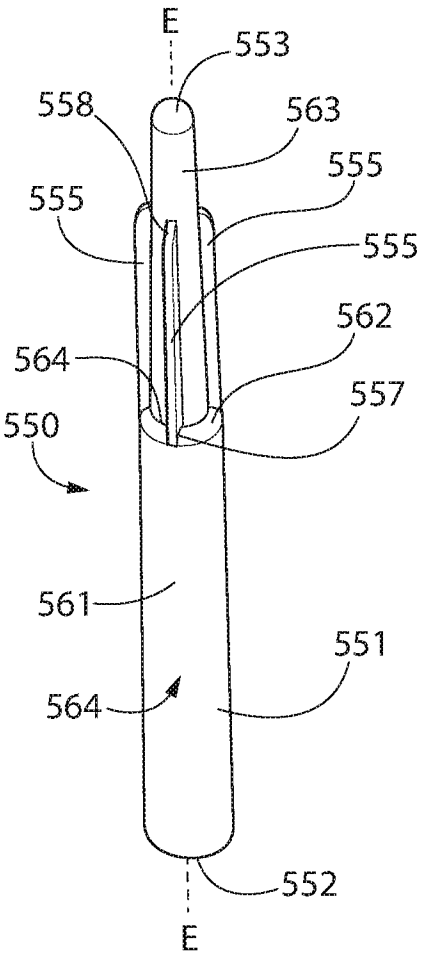
Figure 9B:
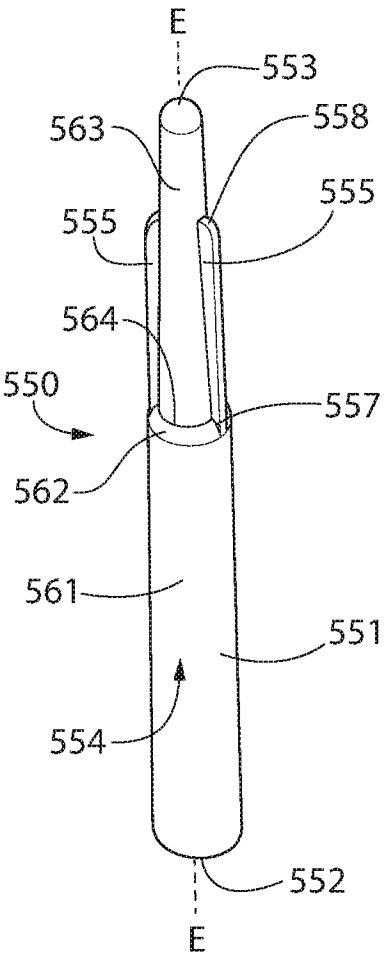
Figure 9A:
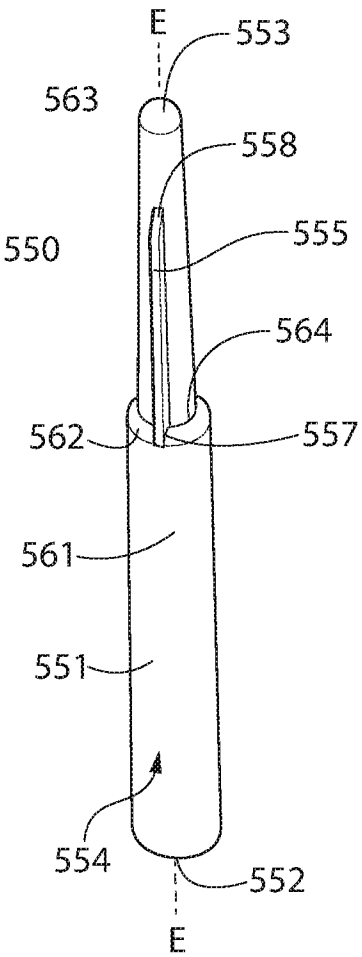
Figure 10C:
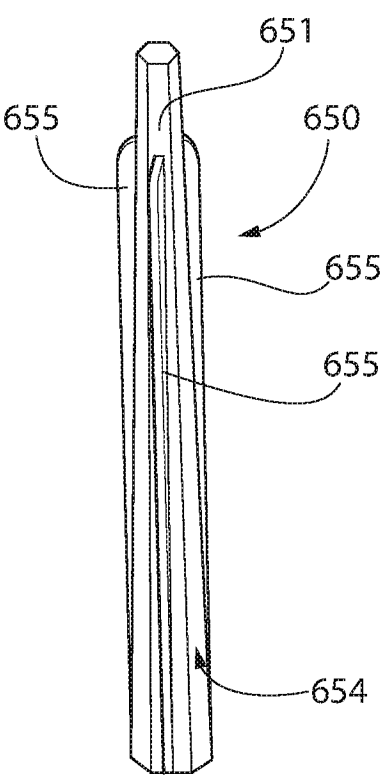
FIGS. 10A-10C are perspective views of bristles in accordance with a still further embodiment of the present invention.
Figure 10B:
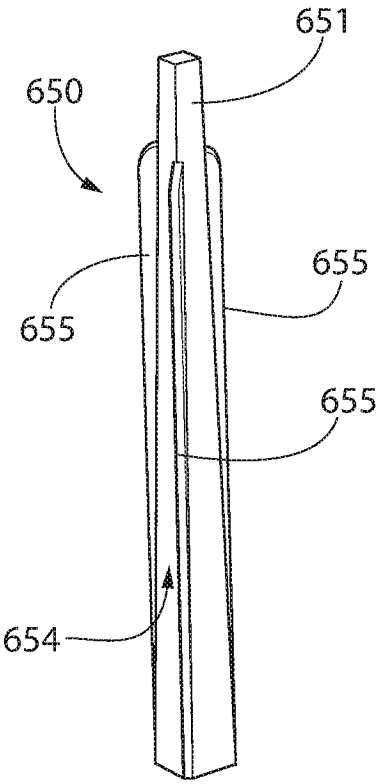
Figure 10A:
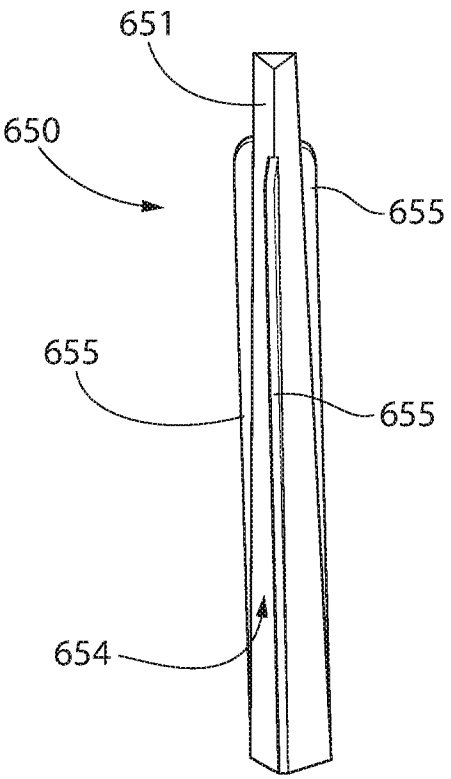

FIG. 11D illustrates yet another modified version of the bristle 750 of FIG. 11A that is similar to the bristle 550 of FIG. 9A in that the body 751 of the bristle 750 comprises first and second longitudinal sections 761, 762 that are distinguishable based on their transverse cross-sectional areas. The rib 755, which extends in a helical manner about the longitudinal axis F-F, is positioned only on the second longitudinal section 762.

Finally, FIG. 11E illustrates a further modified version of the bristle 750 of FIG. 11A that is similar to the bristle 650 of FIG. 10A in that the body 751 of the bristle 750 has a triangular cross-sectional shape rather than being circular or oval. Thus, the body 751 of the bristle 750 in this embodiment is in the shape of an elongated prism rather than a cylinder or cone. In this embodiment, the rib 755 extends from the outer surface 754 of the body 751 of the bristle 750 in a helical manner about the longitudinal axis F-F.

In certain embodiments, some of the bristles may comprise a body comprising a thicker base portion having multiple finger-like protrusions extending from a top surface of the base portion to create multiple touch points during cleaning. Such finger-like protrusions may be circumferentially spaced apart to enable the finger-like protrusions to have increased flexibility during use. In such embodiment, ribs such as those described herein may extend from the body of the bristle. Specifically, such ribs may extend along the entire length of the body including along the thicker base portion and along the finger-like protrusions. Alternatively, the ribs may extend only along the thicker base portion such that the finger-like protrusions are free of the ribs. In another embodiment, the ribs may extend from the body only along the finger-like protrusions such that the base portion is free of the ribs.

Furthermore, in some embodiments combinations of bristles having different cross-sectional areas may be included on the same oral care implement head. Thus, a monolithic cleaning unit may include bristles with larger and smaller cross-sectional areas. Ribs such as those described herein may extend from the bodies of only the smaller cross-sectional area bristles, only the larger cross-sectional area bristles, or from all of the bristles.

Various combinations of the teachings set forth herein are possible and fall within the scope of the present invention. Specifically, different combinations of the different bristles 150, 250, 350, 450, 550, 650, 750 described herein may form a part of the monolithic cleaning unit 140. Specifically, in some embodiments only one of the types of bristles 150, 250, 350, 450, 550, 650, 750 described herein are used on the monolithic cleaning unit 140. In other embodiments, a mixture of the different types of cleaning elements 150, 250, 350, 450, 550, 650, 750 may be used on the same monolithic cleaning unit 140.

The addition of the ribs onto the bristles as described herein provides additional contact edges for cleaning a user's teeth and other oral surfaces. Thus, although there are less of the bristles on the head when using injection molded bristles than with traditional filament bristles, the bristles may have the same or more edges for contacting and cleaning the user's teeth and other oral surfaces. Furthermore, combining different types of the bristles described herein on the same head may provide a more effective cleaning than achieved with currently available oral care implements and toothbrushes.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle and a head having a front surface and an opposing rear surface, the head comprising a support structure and a monolithic cleaning unit, the monolithic cleaning unit comprising:

a base portion coupled to the support structure and forming a portion of the front surface of the head; and a plurality of bristles extending from the base portion and protruding from the front surface of the head;

wherein at least one of the plurality of bristles comprises:

a body having an outer surface, the body extending along a longitudinal axis and having a first longitudinal section extending from a proximal end adjacent the base portion of the monolithic cleaning unit to a distal end and a second longitudinal section extending from the distal end of the first longitudinal section to a distal end of the second longitudinal section, the first longitudinal section having a minimum cross-sectional area that is greater than a maximum cross-sectional area of the second longitudinal section; and at least one rib extending from the outer surface of the body and located entirely on the second longitudinal section of the body.

2. The oral care implement according to claim 1 wherein the distal end of the first longitudinal section forms an annular flange, and wherein the rib extends from a bottom end that is in contact with the annular flange to a top end that is located between the distal end of the first longitudinal section and the distal end of the second longitudinal section, and wherein the first longitudinal section is devoid of ribs extending therefrom.

3. An oral care implement comprising:

a handle and a head having a front surface and an opposing rear surface, the head comprising a support structure and a monolithic cleaning unit, the monolithic cleaning unit comprising:

a base portion coupled to the support structure and forming a portion of the front surface of the head; and a plurality of bristles extending from the base portion and protruding from the front surface of the head;

wherein at least one of the plurality of bristles comprises:

a body having an outer surface that extends along a longitudinal axis from a proximal end that is adjacent the base portion of the monolithic cleaning unit to a distal end; and at least one rib extending from the outer surface of the body in a helical manner about the longitudinal axis.

4. The oral care implement according to claim 3 further comprising a plurality of the ribs extending from the outer surface of the body in a helical manner about the longitudinal axis.

5. The oral care implement according to claim 4 wherein each one of the ribs is spaced apart from each of the other ribs along an entire length of the ribs.

6. The oral care implement according to claim 3 wherein a top end of the rib is spaced apart from the distal end of the body.

7. The oral care implement according to claim 3 wherein the body tapers from the proximal end to the distal end.

8. The oral care implement according to claim 3 wherein each of the plurality of bristles comprises:

a body having an outer surface that extends along a longitudinal axis from a proximal end that is adjacent the base portion of the monolithic cleaning unit to a distal end; and at least one rib extending from the outer surface of the body in a helical manner about the longitudinal axis.

9. The oral care implement according to claim 3 wherein the body comprises a first longitudinal section comprising the proximal end and having a minimum cross-sectional area and a second longitudinal section comprising the distal end and having a maximum cross-sectional area that is less than the minimum cross-sectional area of the first longitudinal section.

10. The oral care implement according to claim 9 wherein the at least one rib is located entirely on the second longitudinal section of the body, the outer surface of the body in the first longitudinal section being smooth and devoid of ribs extending therefrom.

11. The oral care implement according to claim 9 wherein the first longitudinal section of the body comprises a constant cross-sectional area and the second longitudinal section of the body tapers from the first longitudinal section of the body to the distal end of the body.

12. The oral care implement according to claim 3 wherein the head comprises tooth cleaning elements that consists only of the plurality of bristles of the monolithic cleaning unit.

13. The oral care implement according to claim 3 wherein the monolithic cleaning unit comprises between 200 and 250 of the bristles.

14. The oral care implement according to claim 3 wherein the monolithic cleaning unit is formed of an elastomeric material.

15. The oral care implement according to claim 3 wherein the body has a maximum cross-sectional area and wherein the at least one rib extends a maximum distance from the outer surface of the body, a ratio of the maximum diameter to the maximum distance being between 3:1 and 5:1.

16. An oral care implement comprising:

a handle and a head having a front surface and an opposing rear surface, the head comprising a support structure and a monolithic cleaning unit, the monolithic cleaning unit comprising:

a base portion coupled to the support structure and forming a portion of the front surface of the head; and a plurality of bristles extending from the base portion and protruding from the front surface of the head;

wherein at least one of the plurality of bristles comprises a body extending along a longitudinal axis, the body having a first longitudinal section extending from the base portion of the monolithic cleaning unit to a distal end and a second longitudinal section extending from the distal end of the first longitudinal section, the distal end of the first longitudinal section protruding radially from the second longitudinal section, each of the first and second longitudinal sections of the body tapering in a direction away from the base portion of the monolithic cleaning unit.

17. The oral care implement according to claim 16 wherein a transverse cross-sectional area of the first longitudinal section continuously decreases from the base portion towards the distal end of the first longitudinal section, and wherein the second longitudinal section extends from the distal end of the first longitudinal section to a distal end of the second longitudinal section, a transverse cross-sectional area of the second longitudinal section continuously decreasing from the distal end of the first longitudinal section to the distal end of the second longitudinal section.

18. The oral care implement according to claim 16 wherein the distal end of the first longitudinal section forms an annular shoulder that protrudes radially from the second longitudinal section.

19. The oral care implement according to claim 16 wherein the first longitudinal section of the body has a minimum transverse cross-sectional area that is greater than a maximum transverse cross-sectional area of the second longitudinal section of the body.

20. The oral care implement according to claim 16 wherein the body comprises a third longitudinal section extending from a distal end of the second longitudinal section to a distal end of the third longitudinal section, the distal end of the second longitudinal section forming an annular shoulder that protrudes radially from the third longitudinal section, and wherein the second longitudinal section of the body has a minimum transverse cross-sectional area that is greater than a maximum transverse cross-sectional area of the third longitudinal section of the body.

* * * * *